United States Patent [19]

Marchal et al.

[11] Patent Number: 4,676,722

[45] Date of Patent: Jun. 30, 1987

[54] HIGH PERIPHERAL SPEED WHEEL FOR A CENTRIFUGAL COMPRESSOR INCLUDING FIBER LOADED SCOOPS AND A METHOD OF MAKING SUCH A WHEEL

[75] Inventors: Philippe Marchal, Plaisir; André Koenig, Breitenbach, both of France

[73] Assignee: ARAP-Applications Rationnelles de la Physique, Bougival, France

[21] Appl. No.: 569,955

[22] Filed: Jan. 11, 1984

[30] Foreign Application Priority Data

Jan. 26, 1983 [FR] France ..... 83 01162

[51] Int. Cl.[4] ..... F01D 5/30

[52] U.S. Cl. ..... 416/188; 416/191; 416/230; 416/241 A

[58] Field of Search ..... 416/188, 191, 229 R, 416/229 A, 230, 241 A, 241 R, 248; 156/221, 276

[56] References Cited

U.S. PATENT DOCUMENTS

| | | | |
|---|---|---|---|
| 2,857,094 | 10/1958 | Erwin | 416/230 |
| 3,077,297 | 2/1963 | Clarke | 416/188 |
| 3,515,501 | 6/1970 | Palfreyman et al. | 416/230 X |
| 3,518,221 | 6/1970 | Kenyon et al. | 416/230 X |
| 3,521,973 | 7/1970 | Schouw | 416/241 A X |
| 4,098,559 | 7/1978 | Price | 416/248 |
| 4,465,434 | 8/1984 | Rourk | 416/244 A |

*Primary Examiner*—Robert E. Garrett
*Assistant Examiner*—Joseph M. Pitko
*Attorney, Agent, or Firm*—Bachman & LaPointe

[57] ABSTRACT

The invention relates to a high peripheral speed centrifugal compressor of the kind comprising curved hollow sector shaped scoops juxtaposed circumferentially about an axis to form a disc, and a drive shaft for rotating said disc about said axis.

According to the invention, the scoops are made from material loaded with high mechanical strength fibers and are connected together circumferentially and radially by filaments wound and stretched in radial clearances between the scoops, the filaments being of material generally similar to the fibers of the scoops and being coated with a bonding agent compatible with the material of the scoops and the filaments, the bonding agent being cured so as to bond the scoops and filaments solidly together in the form of a stable unitary member.

The resulting wheel has light weight and high mechanical breakage strength, enabling high peripheral speed.

12 Claims, 7 Drawing Figures

FIG. 1
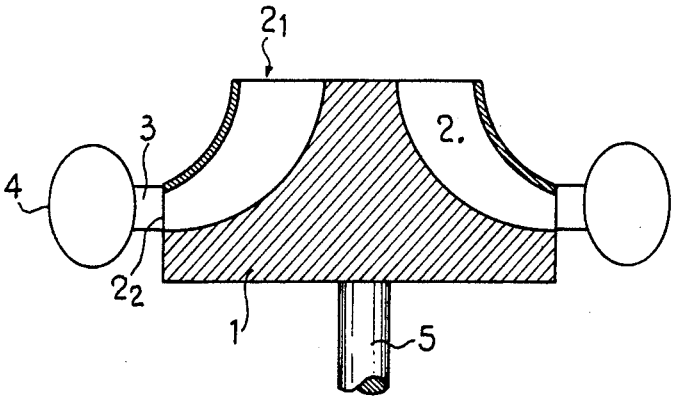
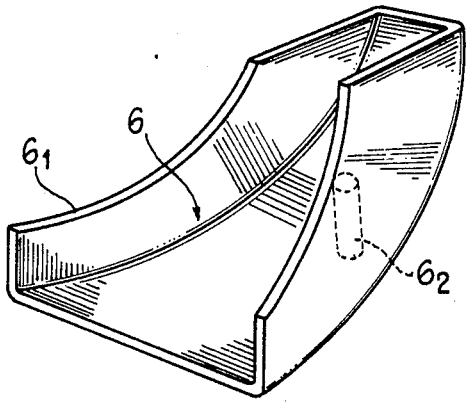
FIG. 2

HIGH PERIPHERAL SPEED WHEEL FOR A CENTRIFUGAL COMPRESSOR INCLUDING FIBER LOADED SCOOPS AND A METHOD OF MAKING SUCH A WHEEL

BACKGROUND OF THE INVENTION

This invention relates to a wheel and in particular to a wheel for a high peripheral speed compressor made from preformed scoops of sector shape, which are juxtaposed and bonded to each other in the circumferential direction to form a unitary assembly of high mechanical breakage strength.

DESCRIPTION OF THE PRIOR ART

Various types of volumetric compressors exist such as piston or axial compressors and screw or centrifugal machines.

A centrifugal compressor consists essentially of a rotor and a stator.

The rotor may comprise vanes rotating about an axis and designed to impel the gas at their rotational velocity so as to impart energy to it.

The stator, besides being the housing of the machine, comprises a part referred to as "diffuser", designed to transform the gas velocity into pressure.

Two types of wheels are available: open or close. In a closed wheel, the vanes are bounded by two surfaces of revolution of which the inner one is connected directly to the shaft of the machine, the path followed by the gas being entirely defined within the rotor.

In this type of design, the housing surrounding the rotor is of relatively simple design.

These closed wheel rotors have the disadvantage of being limited in rotational velocity (300 m/s for example), the external surface of revolution being subjected to higher centrifugal stresses than the vanes. This leads to cracks appearing between the vanes and the external surface, and increasing with the rotational velocity.

Open wheels on the other hand only have the internal surface of revolution, which enables higher rotational velocities to be obtained, but requires a fitter outer housing, whose manufacture is more elaborate and consequently more costly.

Such wheels have been made from metal (steel, aluminum, titanium) by casting or welding, casting being the more common for closed wheels and for small sizes because of the difficulty of obtaining the access needed for welding.

OBJECT OF THE INVENTION

An object of the invention is to provide a novel compressor wheel having both a high breakage strength and a low specific mass, thereby obtaining high rotational velocities and larger wheel diameters. Another object of the invention is to provide a method of making a compressor wheel which avoids costly manufacturing or machining techniques.

SUMMARY OF THE INVENTION

The present invention provides a wheel for a centrifugal compressor comprising a set of hollow curved sector-shaped scoops juxtaposed circumferentially around an axis to form a disc, and a drive shaft for driving said disc in rotation about said axis, said scoops comprising fiber-loaded material, and said scoops being connected circumferentially and radially by filaments stretched radially in clearances between the scoops and by a bonding agent bonding said filaments and said scoops together.

The fibers and filaments are preferably carbon, boron, aromatic polyamide or glass fibres, and the bonding agent is preferably a resin such as an epoxy, polyimide or phenolic resin.

The invention also includes positioning said scoops in a star pattern on a support with radial clearances between adjacent scoops, coating said filaments with said bonding agent, placing the coated filaments in said clearances, said filaments extending generally outwards parallel to the walls of the scoops, curing said bonding agent whereby to bond said scoops and said filaments together and cutting said filaments at the outer edge of the disc and on front face of the disc.

BRIEF DESCRIPTION OF THE DRAWINGS

The present invention is illustrated by way of example in the accompanying drawings in which:

FIG. 1 is a diagrammatic view of a known compressor wheel;

FIG. 2 is a perspective view of a scoop forming part of a compressor wheel in accordance with the present invention;

DETAILED DESCRIPTION

Figure 3:
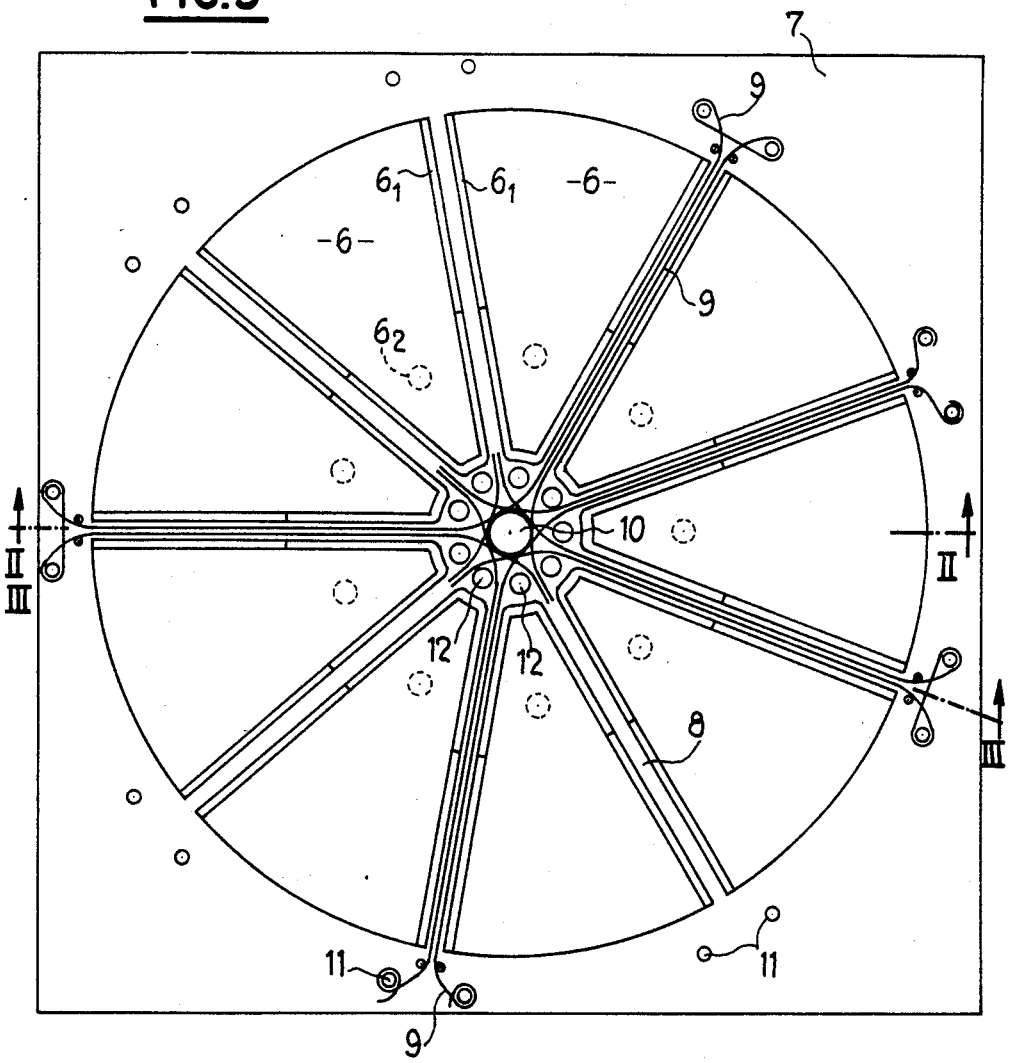
FIG. 3 is a top view of the wheel of FIG. 2 during a stage of its manufacture.

As indicated above by way of introduction, the present invention avoids certain disadvantages encountered with cast or welded metal wheels, and relates to a new type of wheel presenting high mechanical breakage strength for a particularly low mass, and hence a high burst resistance. Accordingly, the present invention enables larger diameters and higher peripheral speeds than those obtainable with previously known compressor wheels.

As shown diagrammatically in FIG. 1, centrifugal compressor wheels are generally formed from a rotor 1 defined by blades 2 of which one end $2_1$ opens at the front face, called the input face, the other end $2_2$ communicating with a fixed diffuser 3 which itself is in relation with a peripheral volute 4. The fluid penetrating into the channel defined by the blades increases in pressure and velocity in the channel, the velocity being transformable into pressure in the diffuser. The rotor is rotated by a drive shaft 5 to which it is coupled and several wheels may be coupled in tandem on the same shaft.

According to the present invention, and following from the preferred method of manufacture described below, the wheel is made from scoops 6 (see FIG. 2) which are made from fibers having a high mechanical breakage strength, each scoop being of sector-shape to define a channel by itself. The wheel is of modular construction, since it is made from a set of scoops 6 juxtaposed in the circumferential direction and connected solidly one with the other, so as to form a stable unitary member, by bundles of radius filaments 9 coated in a bonding agent.

The fibers used in making the scoops are preferably carbon fibers, but it is also possible to use fibers of boron, aromatic polyamides or even glass. These fibers have a sufficiently high mechanical strength to enable high specific velocities to be obtained, but given the uni-directional nature of the fibers, it is necessary to adopt specific morphology in order that the centrifugal forces are transmitted in the direction of the length of the fiber and not perpendicular to it.

Figure 4:
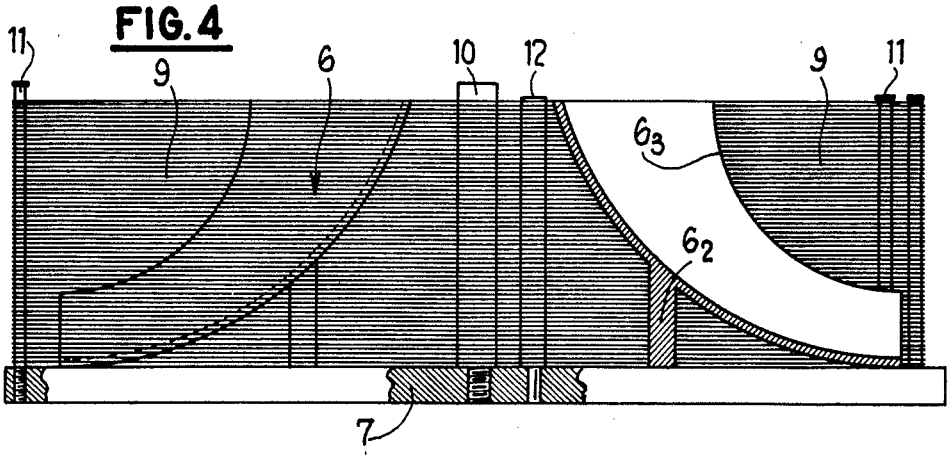
FIG. 4 is a sectional view taken on the line II—II of FIG. 3.

FIGS. 3 and 4 show a method of making a wheel, in accordance with the present invention. The sector shaped scoops 6 are positioned on a table in a star pattern, with radial clearances 8 left between the side walls $6_1$, the positioning of the scoops being facilitated by stabilizer pegs $6_2$ with which they are provided, and which rest like a heel on the flat table 7. The coupling and sealing together of the scoops is next performed using a winding of bundles of radiatins filaments 9 previously coated with a bonding agent whose chemical nature is compatible with the material forming the scoops and that forming the filaments, for example an epoxy resin if the scoops and the bundles of filaments are basically carbon fibers. The filament 9 is continous and is tightly stretched between opposite pairs of scoops, its direction being parallel to the side edges of the scoops, but spreading slightly from the center 10 of the wheel to give an acceptable winding of the filaments which will thus cross each other slightly outside the center and stack in the shape of bundles at the top of the scoops. As seen in FIG. 4, each radial clearance 8 opens onto rods 11 solid with the table and on which the connecting filaments are wound.

When the winding of the bundles of filaments is thus performed, the assembly is polymerized in an oven, so as to obtain a stable and homogeneous unitary disc.

Figure 6:
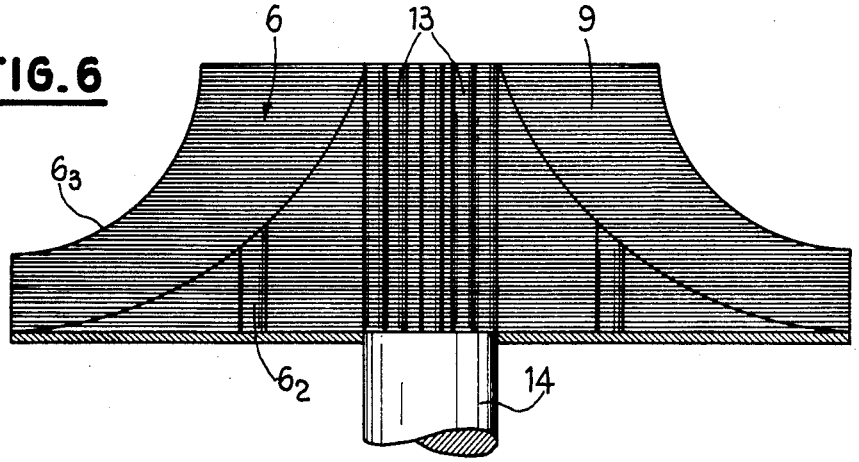
FIG. 6 is a sectional view taken from the line III—III of FIG. 3 showing the coupling of the wheel of FIG. 2 to the shaft of FIG. 5.

It is then sufficient to cut the filaments and de-burr rapidly the disc to obtain a compressor wheel ready for use, with no further machining or shaving operation, other than balancing before or after it is coupled to the transmission shaft. Cutting the filaments is performed at the periphery of the wheel and on its front face following the concave profile $6_3$ of the scoops (see FIG. 4) to obtain the wheel as shown in FIG. 6.

Figure 7:
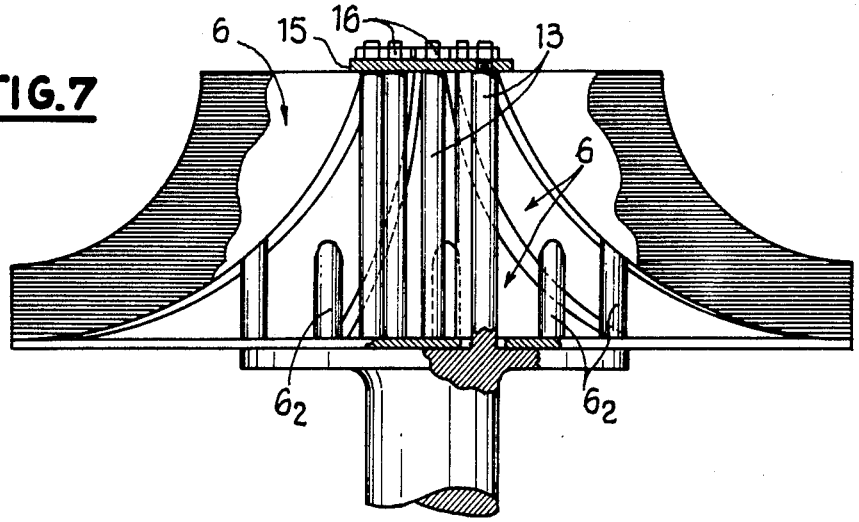
FIG. 7 is a sectional view showing the coupling of the wheel with a metallic type of shaft.

The carbon fiber wheel can be coupled either to a metal shaft or to a shaft which is also made of carbon fiber. In the first case, as shown in FIG. 7, it is possible during the manufacture of the wheel and in particular during the winding of the bundles of connecting filaments to form axial channels obtained by pins 12 passing right through the wheel and which, when it is unmolded, form passages into which are introduced fingers 13 forming the end of the drive shaft 14. These fingers are attached solidly to the wheel by a pressure plate 15 and bolts 16 fixed on the end of each one of the fingers 13.

Figure 5:
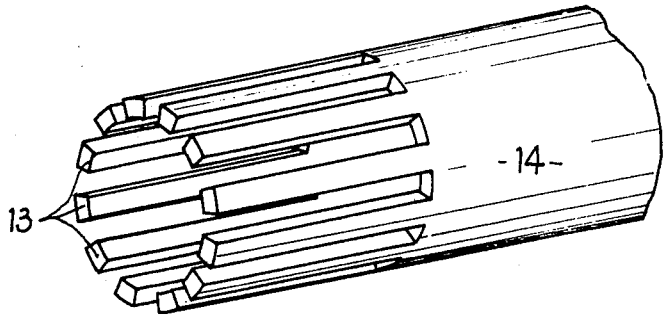
FIG. 5 is a perspective view of a preferred embodiment of a drive shaft for the wheel.

If the drive shaft is made of carbon fiber, then like the metal shaft, it comprises fingers 13 as shown in FIG. 5, but in this case they will be positioned, inserted and sealed to the wheel as the winding of the filaments progresses. It is sufficient in this case for the table 7 to include a central opening for the passage of the shaft, and for the fingers 13 to be disposed between the shaft 10 of the wheel and the ends of scoops (as indicated by the reference 12 on FIG. 3) for the shaft to be coupled to the wheel by the bonding of the filaments like the scoops. After cooling and removing from the table 7, the wheel and drive shaft will form a homogeneous and unitary assembly.

To obtain suitable thermal resistance, the assembly is then baked in an oven, whose temperature is defined by the type of resin used. Also, if a closed wheel is to be made, the scoops may be covered with a continous tulip-shaped web also made from bonded carbon fibers, while leaving free the inlet apertures of the scoops opening into the front face of the wheel, the opposite end of the scoops communicating in known fashion with a rotor diffuser having the general shape of an annular crown. Also , turbulence can be avoided and aerodynamics improved by bonding to the rear face of the wheel a disc in carbon fiber, girdling the drive shaft which, if it is also made of fiber, may advantageously be sheathed in a metallic sleeve to act as axis as well.

Thus, due to the light weight and high strength of the carbon fiber forming the scoops and by taking and distributing the centrifugal forces on the bundles of connecting filaments, a wheel is obtained which has a low specific mass enabling high periheral speeds and bigger diameters than with known compressor wheels in metal, the method of making the improved wheel being simple and reducing to a minimum the machining operations which weighted until now on the cost of making compressor wheels.

We claim:

1. A wheel for a centrifugal compressor, comprising a set of hollow curved sector-shaped scoops having generally vertical sidewalls juxtaposed circumferentially around an axis to form a disc, and a drive shaft for driving said disc in rotation about said axis, said scoops comprising fiber-loaded material, and said scoops being connected circumferentially and radially by a winding of bundles of flexible filaments stretched radially and stacked generally vertically and coextensively with said sidewalls in clearances between the scoops and extending across the entire diameter of said wheel and by a bonding agent bonding said filaments and said scoops together, wherein said scoops have their bottom backing the hub of the wheel being curved so as to smoothly guide the flow passing through the wheel from a direction substantially paralled to the rotation axis of said wheel to a direction substantially perpendicular to said rotation axis.

2. A wheel as claimed in claim 1, wherein said fibers comprise a material selected from the group consisting of carbon, boron, and aromatic polyamide.

3. A wheel as claimed in claim 1 or 2, wherein said filaments comprise a material selected from the group consisting of carbon, boron, and aromatic polyamide.

4. A wheel as claimed in claim 1 or 2, wherein said bonding agent comprises a resin material.

5. A wheel as claimed in claim 1, wherein said drive shaft comprises a carbon fiber member, and fingers projecting from an end portion of said member, said fingers being inserted in said disc for securing said drive shaft to said disc.

6. A wheel as claimed in claim 5, wherein said drive shaft comprises a metal sleeve sheathing said carbon fiber member.

7. A method of making a compressor wheel comprising positioning hollow curved sector-shaped scoops having sidewalls in a star pattern on a support with radial clearances between opposed surfaces of sidewalls of adjacent scoops, coating filaments with a bonding agent, placing said coated filaments in said clearances filling said clearance substantially, said filaments extending generally outwards parallel to the walls of the scoops and across the entire diameter of said wheel, curing said bonding agent whereby to bond said scoops and said filaments together throughout the opposed surfaces to form a unitary disc and cutting and shaping said filaments at the outer edge of the disc and on a front face of the disc to a predetermined profile, including the step of further positioning said scoops so that their bottom backing the hub of the wheel being curved so as to smoothly guide the flow passing through the wheel from a direction substantially parallel to the rotation axis of said wheel to a direction substantially perpendicular to said rotation axis.

8. A method as claimed in claim 7 and including obturating a rear face of said wheel with a disc applied thereto.

9. A method as claimed in claim 7 or 8, further comprising securing the wheel to a drive shaft comprising a carbon fiber member, and inserting fingers projecting from an end portion of said member into said disc before curing of said bonding agent.

10. A method as claimed in claim 7 or 8, wherein said drive shaft comprises a metal member and fingers projecting from an end portion of said metal member, said disc defining channels extending therethrough, and said fingers being inserted in said channels after curing said bonding agent and being secured to said disc at a face opposite said metal member.

11. A wheel as claimed in claim 1 wherein said filaments are continuous.

12. A wheel as claimed in claim 1 wherein scoops form a symmetrical circumference.

* * * * *